US005178329A

United States Patent [19]

Yang

[11] Patent Number: 5,178,329

[45] Date of Patent: Jan. 12, 1993

[54] REMOTE CONTROLLED REFRACTORY GUNNING APPARATUS

[75] Inventor: Sandy S. Yang, East Brunswick, N.J.

[73] Assignee: Quigley Inc., New York, N.Y.

[21] Appl. No.: 678,902

[22] Filed: Mar. 28, 1991

Related U.S. Application Data

[63] Continuation of Ser. No. 348,245, May 5, 1989, abandoned.

[51] Int. Cl.[5] ..... B05B 3/02

[52] U.S. Cl. ..... 239/227; 239/264; 239/DIG. 19

[58] Field of Search ..... 239/226, 263.1, 264, 239/210, 225.1, 255, 227, DIG. 19

[56] References Cited

U.S. PATENT DOCUMENTS

| | | | |
|---|---|---|---|
| 3,799,445 | 3/1974 | Marino | 239/242 |
| 4,301,998 | 11/1981 | Rodway | 266/281 |
| 4,325,512 | 4/1982 | Kenshol | 239/84 |
| 4,421,275 | 12/1983 | Gratton | 239/226 |
| 4,779,798 | 10/1988 | Natolino et al. | 239/226 |

FOREIGN PATENT DOCUMENTS

| | | | |
|---|---|---|---|
| 2849159 | 5/1979 | Fed. Rep. of Germany | 239/226 |
| 2192350 | 1/1988 | United Kingdom | 239/263.1 |

*Primary Examiner*—Andres Kashnikow
*Assistant Examiner*—Christopher G. Trainor
*Attorney, Agent, or Firm*—Peter C. Richardson; Lawrence C. Akers; Robert F. Sheyka

[57] ABSTRACT

A vertical remote-controlled gunning apparatus having a horizontal nozzle wherein the water supply conduits and material supply conduits are integrated into a mixer-swivel head which controls the swiveling and rotation of said conduit.

5 Claims, 5 Drawing Sheets

REMOTE CONTROLLED REFRACTORY GUNNING APPARATUS

This is a continuation of application Ser. No. 348,245, filed on May 5, 1989, now abandoned.

BACKGROUND OF THE INVENTION

The present invention concerns refractory lining repair. More specifically, it concerns an apparatus for the repair of the refractory lining of vessels in need of such repair, e.g. blast furnaces, ladles, coke ovens, smokestacks and the like.

The apparatus referred to in U.S. Pat. No. 3,799,445 functions very well for its intended purpose. However, due to the large amount of extremely abrasive refractory material transported through the conduit, frequent maintenance is necessary. Because of the extreme wear caused by the abrasive refractory material, it is desirable to have a simplified construction which is more durable and easier to maintain.

SUMMARY OF THE INVENTION

The present invention is directed to a vertical refractory gunning apparatus comprising:

(i) a rotatable gunning conduit terminating at its lower extremity in a nozzle:

(ii) a control unit:

(iii) bearing means rotatably connecting and mounting said gunning conduit from said control unit:

(iv) a water supply conduit supplying water to said control unit:

(v) a material supply conduit supplying refractory material to said control unit:

(vi) a mixer-swivel head in said control unit, said mixer-swivel head comprising:

(a) means for supplying refractory material from said material supply conduit to said mixer-swivel head:

(b) means for supplying water from said water supply conduit to said mixer-swivel head:

(c) a bearing assembly in said mixer-swivel head, said bearing assembly comprising an inner casing surrounding said water supply means, bearing means surrounding said inner casing and an outer casing surrounding said bearing; whereby rotation and swiveling of said conduit is substantially controlled by said bearing assembly; and (vii) means for controlling said mixer-swivel head.

Preferred is the apparatus wherein said bearing assembly and said water supply means are lined with an abrasion resistant material.

Also preferred is the apparatus wherein said nozzle is lined with an abrasion resistant material.

Further preferred is the apparatus wherein said water supply means comprises a water ring.

Also further preferred is the apparatus wherein said means for controlling said mixer swivel head comprises (i) an oscillating drive in said control unit:

(ii) a drive coupling in said control unit connecting said oscillating drive to said mixer-swivel head:

(iii) actuating means connected to said oscillating drive for selectively actuating it to control the angular orientation of said nozzle whereby said nozzle is angularly oriented about said vertical gunning conduit in stationary and oscillating modes of operation.

Especially preferred is the apparatus wherein said control unit is disposed within a control casing.

Also preferred is the apparatus wherein means for illumination are mounted on said casing.

DETAILED DESCRIPTION OF THE INVENTION

Figure 1:
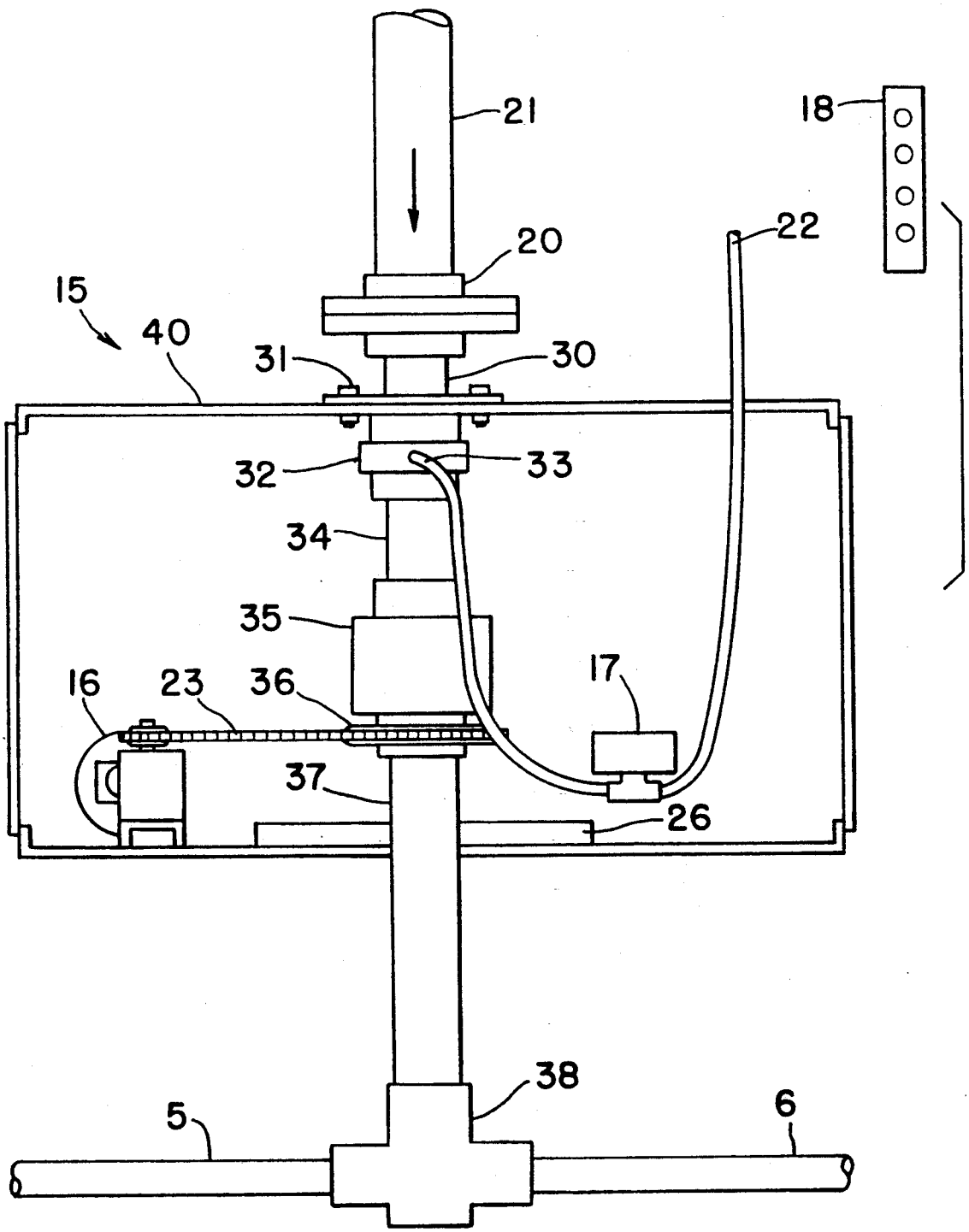
FIG. 1 PRIOR ART
FIG. 1 is a schematic view of the pieces in the assembly of the previous gunning conduit system.

FIG. 1 illustrates the system in the device of U.S. Pat. No. 3,799,445. In the event of rebuild due to wear in the conduit system, pipe nozzle 6 as well as counter balance 5 and spreader head 38 must be removed as the apparatus exits the refractory lined vessel. Once the material supply conduit union 20 with material supply conduit 21 attached is removed, the apparatus is moved to an open area for rebuilding.

In the process of rebuilding, the external structure must be totally removed and replaced. First, the apparatus is inactivated via control box 18. Chain 23 must be rotated to access the chain connecting link 1 (not shown) which is then removed to free chain 23. Then two set screws (not shown) in bearing 26 are loosened and the four bolts 31 holding the water- refractory material mixing head 32 in place must be removed. Hose nipple 33 leading from water supply conduit 22 controlled by water control unit 17 must also be removed. The internal conduit can now be removed through the top of conduit housing 40.

Each piece of the internal conduit must be replaced. Pipe nipples 30 and 34 are screwed back into both ends of water material mixing head 32. The other end of pipe nipple 34 is attached to swivel head 35 and pipe nipple 37 is attached to the down side of swivel head 35. The rebuilt conduit is then lowered through conduit housing 40. Chain 23 is then placed around sprocket 36 and the connecting link secured. Motor 16 is appropriately adjusted for the proper tension on chain 23. The bearing 26, hose nipple 33, mixer head 32, material supply conduit union 20, spreader head 38, pipe nozzle 39 and counter balance 5 are then reinserted into their respective locations.

Figure 2:
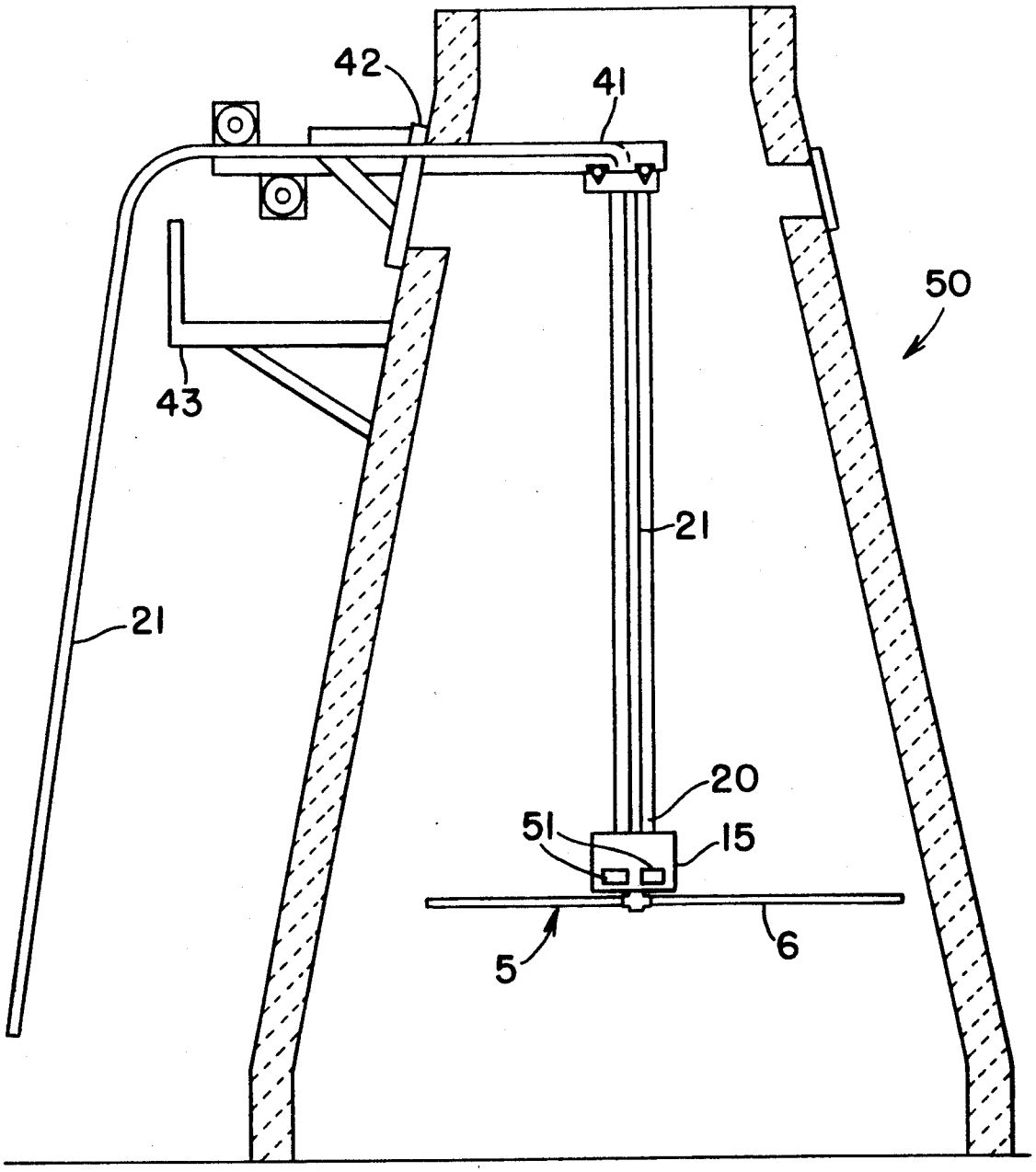
FIG. 2 is an overall schematic view in elevation of one embodiment of the present invention being used to spray a refractory lined vessel through a created opening near the top of the vessel.

In the present invention, as illustrated, for example, in FIG. 2, the vertical gunning apparatus 15 is lowered into the refractory lined vessel 50 from the top of the vessel or through a opening 42 created by workmen using platform 43 near the top of the vessel as shown in FIG. 2. The apparatus 15 is lowered into the refractory lined vessel 50 and suspended in place by a cantilevered beam 41 attached to the door frame 42 outside of the vessel 50. The refractory material feeds in through the top of the gunning conduit housing 40 through the material transport hose 21. Water feeds in through conduit 22 (not shown).

Figure 3:
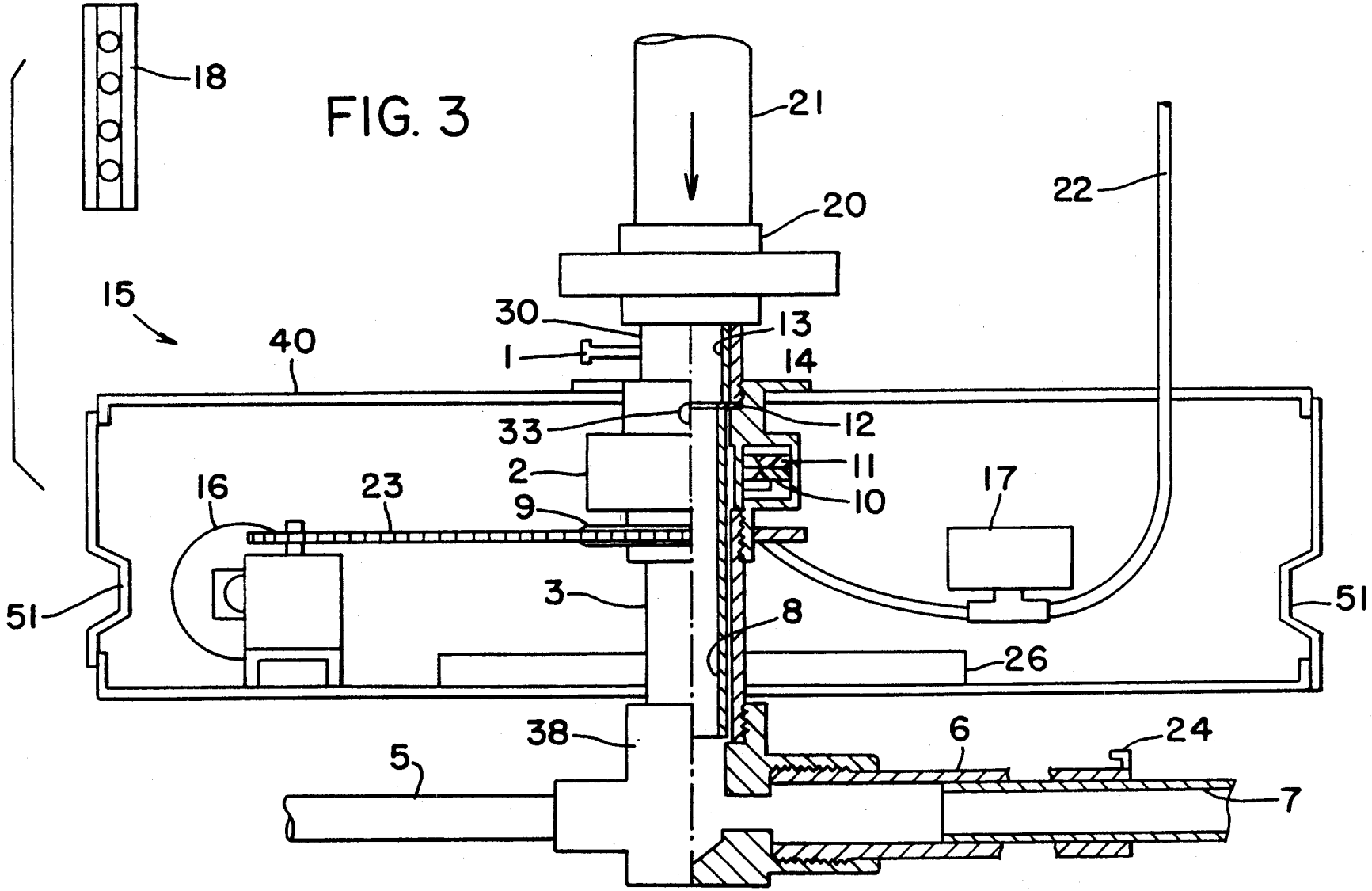
FIG. 3 is a cross sectional view through the housing of the invention and a cross sectional view of the gunning conduit.
Figure 4:
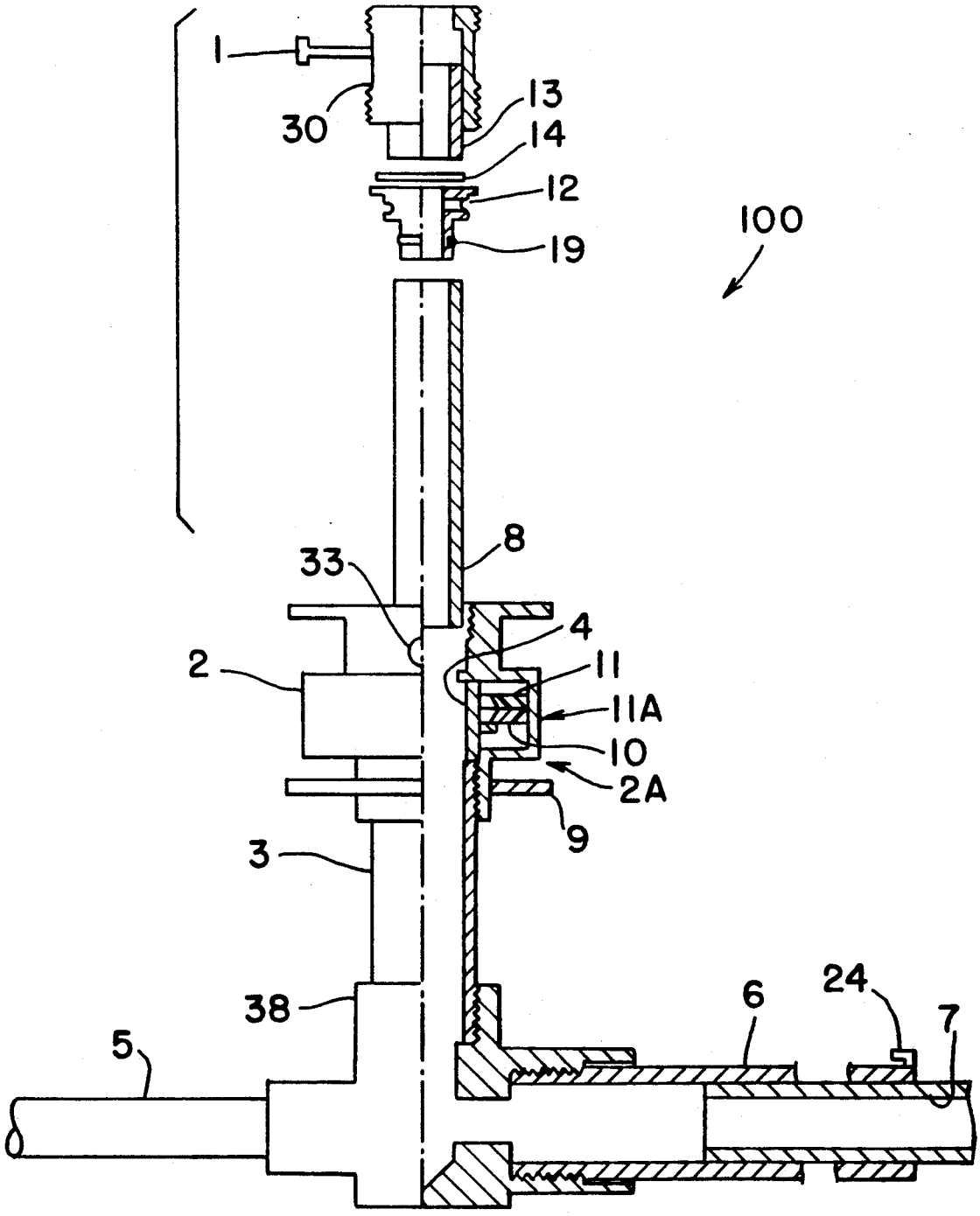
FIG. 4 is a partial cross-sectional exploded view of the mixer swivel head of the present invention.

The refractory material is transported through material supply conduit 21, as shown in FIG. 3, into a material supply conduit union 20 and material supply conduit union nipple 30 equipped with handle 1 with nipple 30 being lined with an abrasive resistant liner 13. The refractory material then enters the mixer-swivel head 2, where the water enters through water supply conduit nipple 33 in the mixer-swivel head 2 and is injected in through a water ring 12. Rubber seal 14 and O-rings 19, as shown in FIG. 4, avoid any possible leakage by sealing water ring 12. The water is mixed with the refractory material in the mixer-swivel head 2.

Bearing assembly 11 is illustrated in FIG. 4. Bearing assembly 11 comprises inner casing 4 surrounding water ring 12 and bearing 11A surrounding inner casing 4. Bearing 11A is secured in place by locknut 10 and bearing 11A is, in turn, surrounded by outer casing 2A. Since inner casing 4A remains stationary and bearing 11A and outer casing 2A are in cooperation with each other, rotation of outer casing 2A is controlled by bearing 11A. Thus, both rotation and swiveling of conduit 100 is substantially controlled by bearing assembly 11, without the need for a separate swivel coupling. Sprocket 9, driven by a reversible motor 16, remotely controlled from outside of the refractory lined vessel, surrounds outer casing 2A and also controls the rotating and swiveling of conduit 100. As the wet mixture continues to move through the conduit, it enters pipe nipple 3 also lined with abrasive resistant liner 8. The liner 8 fits tightly onto the water ring 12 and also renders water ring 12 stationary. Pipe nipple 3 joining the bottom of the mixer-swivel head 2 to the spreader head 38 rotates as it is driven by means of bearing 26. The refractory mixture is then applied through nozzle 6, also lined with an abrasive resistant liner 7, secured, for example, by set screws 24, which applies the wet refractory material perpendicular to the surface of the vessel walls. Also shown in FIGS. 2 and 3 are lights 51 on the outside of housing 40.

The oscillating drive mechanism of the vertical remote-controlled refractory apparatus is disclosed in U.S. Pat. No. 3,799,445, which disclosure is incorporated herein by reference. Briefly, as illustrated in FIGS. 2-4 of U.S. Pat. No. 3,799,445, the apparatus operates by means of an electric drive motor rotating a crank disc connected to a drive portion of a clutch. Thus rotation of the crank disc oscillates the drive portion of the clutch.

In the event of necessary on-the-job rebuilding, the only pieces that would need to be replaced are: the material supply conduit union nipple liner 13, the water ring 12, the pipe nipple liner 8, and, if necessary, liner 7 in nozzle 6, since these are the only pieces that come in contact with the abrasive refractory material. They can all be accessed without disassembling the entire unit. In fact, most of the rebuild can be performed from the top of the conduit housing 40 in a minimal amount of time.

The ease of repair of the unit is also illustrated in FIG. 4. Once the material supply conduit union nipple 30 is removed by the handle 1 provided (no need for any special tools), the liner 13 in the material supply conduit union nipple 30 can be replaced and the water ring 12 as well as liner 8, in lower pipe nipple 3 can be accessed. Liner 7 in nozzle 6 can also be easily replaced by loosening the set screws 24 that hold the liner 7 in place. The liner 7 can then be removed and replaced and the set screws 24 tightened.

Figure 5:
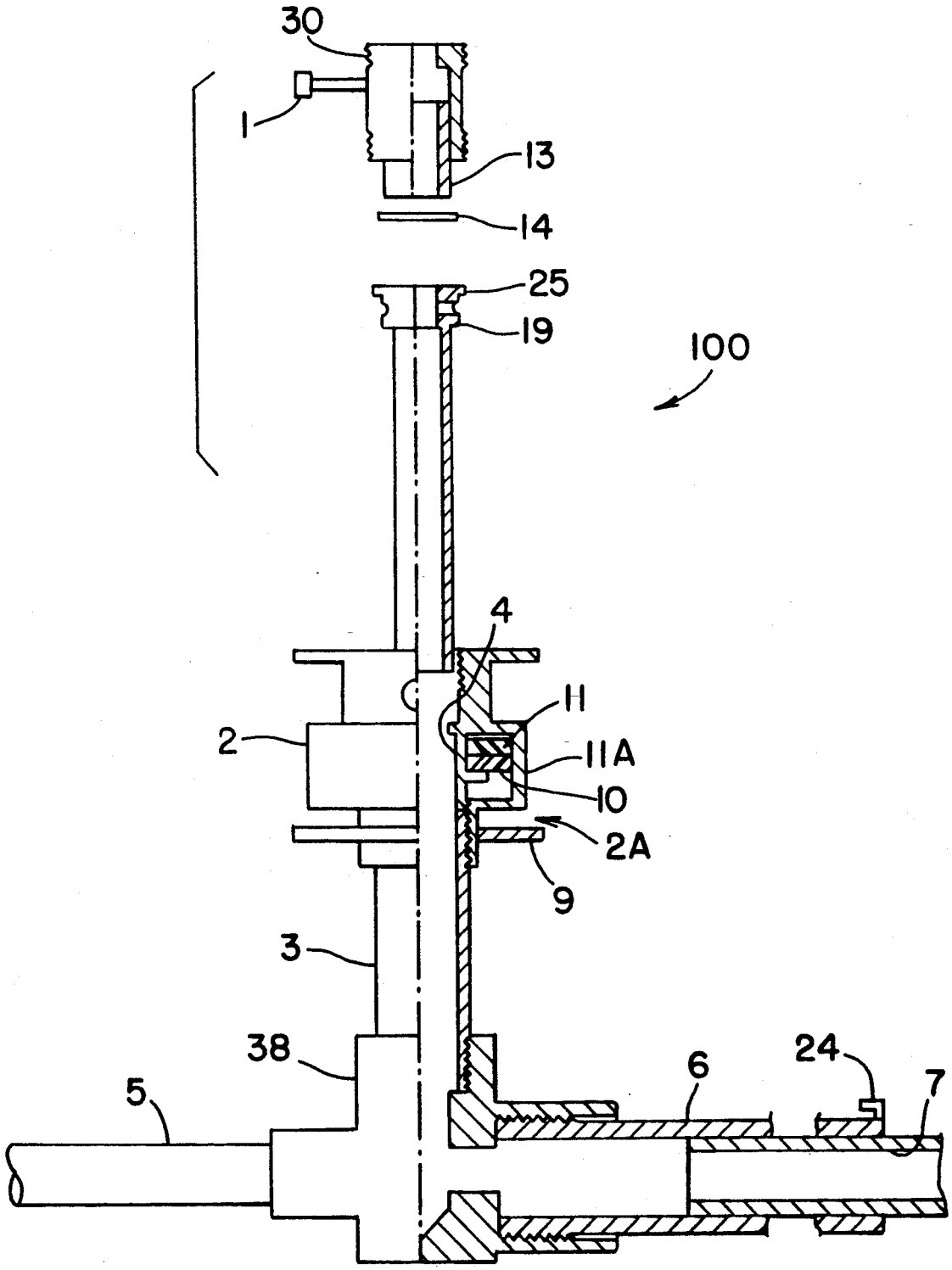
FIG. 5 is a partial cross-sectional view of an alternate assembly of the inserts in the invention.

To further enhance the invention and provide for an even more simplified construction, the water ring 12 and liner 8 in pipe nipple 3 (FIG. 4), can be combined into one piece, the water ring-liner insert 25 as shown in FIG. 5. In this construction the water ring-liner insert 25 is molded as one piece with the O-rings 19 in place to seal off the water. The water ring liner insert slides into place from the top of the mixer swivel head 2. The rubber gasket 14 is then placed on top of the water ring-liner insert 25 to seal off the water. Liner 13 in material supply conduit union nipple 30 is replaced, the material supply conduit union nipple 30 may be tightly replaced using handle 1. The gunning apparatus is ready for service again. Thus, the rebuilding of the apparatus consists of only the removal of one piece, the material supply conduit union nipple 30. The gunning apparatus is ready for service in a minimal amount of maintenance time. Also, the abrasion resistant liners 7,8,13 prolong the life of the conduit, thus, reducing the incidence of rebuilding time.

I claim:

1. A vertical refractory gunning apparatus comprising:
   (i) a rotatable vertical gunning conduit having an upper and lower extremity, said gunning conduit terminating at the lower extremity in a nozzle;
   (ii) a housing, said gunning conduit being located within said housing;
   (iii) a water supply conduit entering and supplying water to the apparatus within said housing;
   (iv) a material supply conduit entering and supplying refractory material to the apparatus within said housing;
   (v) a mixer-swivel head located within said housing comprising,
      (a) means for connecting said material supply conduit to said mixer-swivel head;
      (b) means for connecting said water supply conduit to said mixer-swivel head;
      (c) means for mixing the refractory material with the water in said mixer-swivel head;
      (d) a bearing assembly in said mixer-swivel head, said bearing assembly comprising an inner casing surrounding said means for mixing the refractory material with the water, bearing means surrounding said inner casing and an outer casing surrounding said bearing means, whereby rotation of said gunning conduit is facilitated by said bearing assembly;
   (vi) a control unit disposed in the water supply conduit, said control unit controlling amount of water supplied to the mixer-swivel head; and
   (vii) an abrasion resistant liner lining the bearing assembly and the means for mixing the refractory material with the water, said liner and said means for mixing the refractory material with the water being removable through the top of the housing as a unit separable from said bearing assembly.

2. The apparatus of claim 1 wherein said nozzle is lined with an abrasion resistant material.

3. The apparatus of claim 1 wherein said means for mixing the refractory material with the water comprises a water ring.

4. The apparatus of claim 1 wherein said means for controlling said mixer swivel head comprises
   (i) an oscillating drive in said control unit;
   (ii) a drive coupling in said control unit connecting said oscillating drive to said mixer-swivel head;
   (iii) actuating means connected to said oscillating drive for selectively actuating it to control the angular orientation of said nozzle whereby said nozzle is angularly oriented about said vertical gunning conduit in stationary and oscillating modes of operation.

5. The apparatus of claim 1 wherein means for illumination are mounted on said housing.

* * * * *